United States Patent [19]

Adams

[11] Patent Number: 4,538,367

[45] Date of Patent: Sep. 3, 1985

[54] FOOTWEAR LACING ASSEMBLY

[75] Inventor: Thomas M. Adams, San Antonio, Tex.

[73] Assignee: Kaepa, Inc., San Antonio, Tex.

[21] Appl. No.: 525,725

[22] Filed: Aug. 23, 1983

[51] Int. Cl.[3] ..... A43B 11/00; F16G 11/04

[52] U.S. Cl. ..... 36/50; 24/117; 24/140

[58] Field of Search ..... 36/50, 45; 24/140, 141, 24/145, 122, 117, 68 SK, 170, 166

[56] References Cited

U.S. PATENT DOCUMENTS

| | | | |
|---|---|---|---|
| 1,095,700 | 5/1914 | Bostwick | 24/122 |
| 1,830,646 | 11/1931 | Grundlehner | 24/117 |
| 3,085,823 | 4/1963 | DeBaere | 24/122 |
| 3,546,796 | 12/1970 | Adams | 36/50 |
| 4,200,998 | 5/1980 | Adams | 24/117 |

FOREIGN PATENT DOCUMENTS

| | | | |
|---|---|---|---|
| 193275 | 9/1956 | Austria | 36/50 |
| 25001 | 11/1901 | Switzerland | 24/145 |
| 181518 | 12/1935 | Switzerland | 36/50 |
| 7868 | of 1912 | United Kingdom | 24/140 |
| 366177 | 2/1932 | United Kingdom | 36/50 |

*Primary Examiner*—Werner H. Schroeder
*Assistant Examiner*—Steven N. Meyers
*Attorney, Agent, or Firm*—Cohn, Powell & Hind

[57] ABSTRACT

This lacing assembly is for use with an article of footwear and includes lower and upper vamp sections connected by a single continuous lace. The lower vamp section includes opposed vamp portions having lace-receiving elements at the lower portion and upwardly adjacent lace-receiving locking elements fixedly attached to said vamp portions. The upper vamp section includes opposed vamp portions having lace receiving elements and the lower and upper vamp sections are secured by a single continuous lace. The opposed locking elements of the lower vamp permit the fit of the lower vamp section to be adjusted selectively and independently of the upper vamp sections.

8 Claims, 3 Drawing Figures

FIG. 3
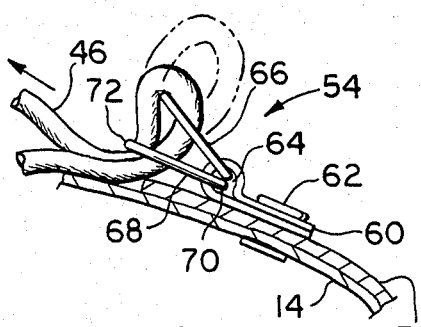
FIG. 2
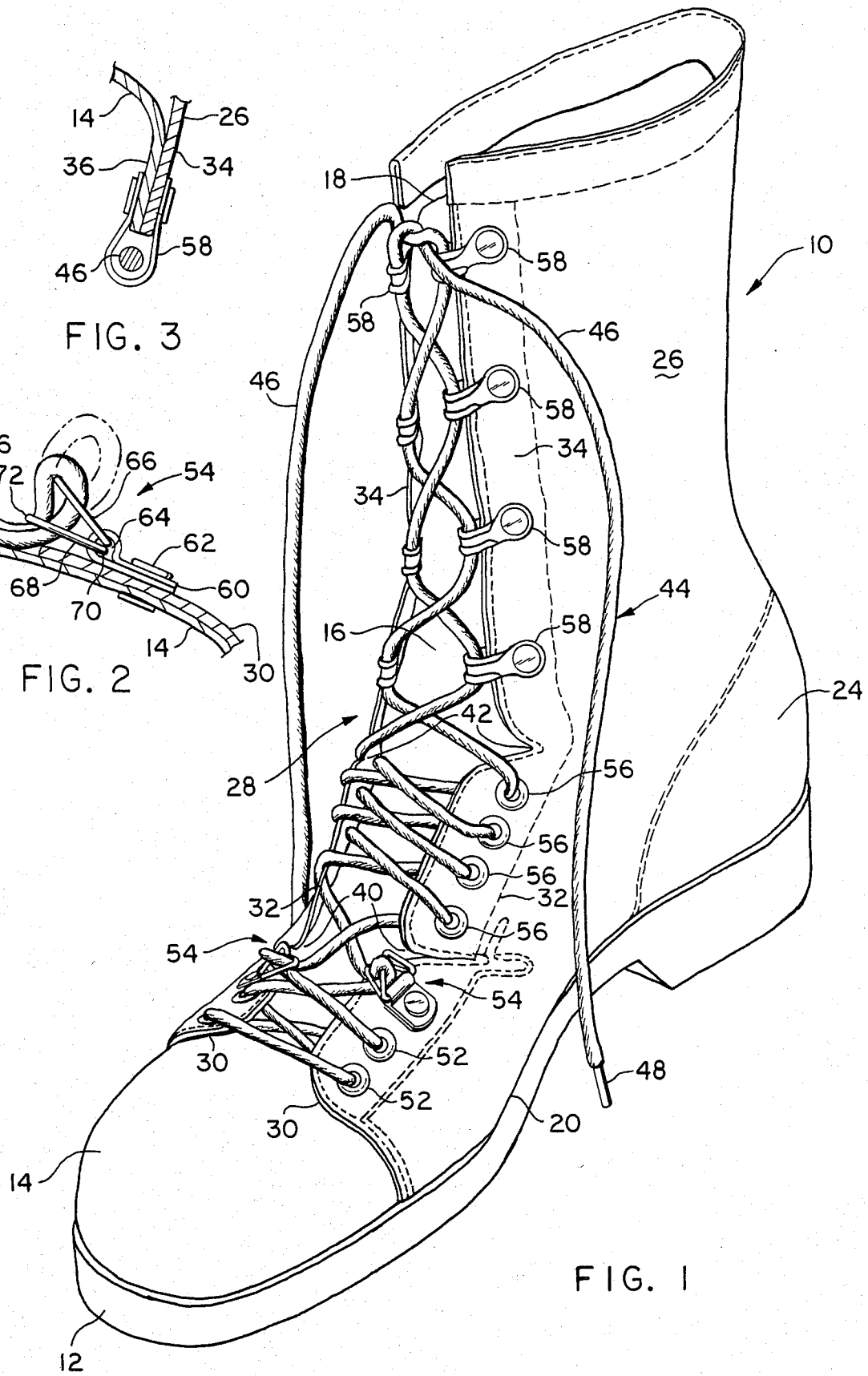
FIG. 1

FOOTWEAR LACING ASSEMBLY

BACKGROUND OF THE INVENTION

This invention relates generally to improvements in the lacing assembly for an article of footwear, and more particularly to an improved lacing assembly for an article of footwear in which lower and upper vamp sections can be selectively adjusted and maintained to fit different portions of the foot independently while utilizing a continuous single lace between said vamp sections.

Two prior patents of particular interest in this field and having the same inventor as this application are U.S. Pat. No. 3,546,796 and U.S. Pat. No. 4,200,998. In the former patent an athletic shoe is disclosed having separate lower and upper vamp sections. In this shoe, each vamp section includes a separate lace and, while it is intended that each vamp section can be adjusted to suit separate portions of the foot, there are disadvantages in using separate laces for each vamp since the results in having four lace ends and two bows on each shoe. The latter patent overcomes this problem to some extent by providing a single continuous lace which extends between the upper and lower vamp sections and a clamp which is disposed between the upper and lower vamp sections for selectively adjusting the fit. This lacing arrangement overcame the aforementioned problem of having additional lace ends and bows but the single centralized clamp provided on each shoe is somewhat complicated and requires more manual dexterity to operate than is desirable in some cases.

The present lacing assembly overcomes the above problems in a manner not disclosed in the known cited art.

SUMMARY OF THE INVENTION

This lacing assembly for an article of footwear is particularly suitable for use with a boot such as a military boot or working boot and provides for adjusting and maintaining the fit of the lower vamp section independently of the upper vamp sections and utilizes a single continuous lace presenting a normal appearance and having the capability of being conventionally tied at the upper end.

The lacing assembly provides first and second vamp sections each including opposed vamp portions. The first, lower vamp portions include opposed lace-receiving means at the lower end and opposed lace-receiving locking means upwardly adjacent of said lace-receiving means and attached to associated vamp portions. The second vamp portions include a plurality of opposed lace-receiving means. A single continuous lace having opposed side lengths is provided, said side lengths being received by opposed lace-receiving means and opposed lace-receiving locking means in said first vamp portions and said side lengths extending between said first and second vamp sections and being received by opposed lace-receiving means in said second vamp portions, the lace being received by said lace-receiving locking means in selectively lockable relation to permit the first vamp section to be adjusted and maintained in adjustment substantially independently of the second vamp section.

It is an object of this invention to provide that the lace-receiving locking means in the first vamp portion are double-loop fasteners to secure the lace.

It is another aspect of this invention to provide that the double loop fasteners each includes a base portion attached to the vamp portion and having an opening and a pair of overlying wire loop elements each having hinged portions received by the base opening in hinged relation.

It is yet another object of this invention to provide that the wire fastener loops are generally triangular in configuration to provide an outer apex portion to facilitate the locking action of the overlying loops.

It is still another aspect of this invention to provide a third vamp section disposed upwardly adjacent of the second vamp section which includes opposed vamp portions having a plurality of lace-receiving means.

Another aspect of this invention is to provide that the article of footwear is a boot having upwardly extending side leg portions providing the third vamp section.

In still another aspect of this invention the lace-receiving means in the first vamp portions are eyelets, the lace-receiving locking means in the first vamp portions are double-looped fasteners and the lace receiving means in the third vamp section are U-shaped single loop elements.

It is still another aspect of this invention to provide that the first and second vamp sections are separated by V-shaped slits between upwardly adjacent vamp portions to facilitate vamp flexibility.

BRIEF DESCRIPTION OF THE DRAWINGS

FIG. 1 is a perspective view of a boot having the lacing assembly,

FIG. 2 is an enlarged sectional view through a vamp portion showing the double loop fastener, and FIG. 3 is an enlarged sectional view through a vamp portion showing a single loop fastener.

DESCRIPTION OF THE PREFERRED EMBODIMENT

Referring now by reference numerals to the drawings and first to FIG. 1 it will be understood that the boot 10 includes a sole 12, a front toe portion 14, attached to the sole 12 and a tongue 16 integrally formed with said toe portion 14 and having a free upper end 18. The boot 10 also includes opposed side portions 20 attached to the sole at their lower end 22 and including side quarters 24 and upper side portions 26. As shown, the boot also includes a vamp generally indicated by numeral 28.

In the embodiment shown, the vamp 28 includes a first vamp section disposed adjacent to the toe portion 14 and having oppositely disposed vamp panel portions 30, a second vamp section disposed upwardly adjacent of the first vamp section and having oppositely disposed vamp panel portions 32, and a third vamp section disposed upwardly adjacent of the second vamp section and having oppositely disposed vamp panel portions 34. The tongue side margins 36, as generally shown in FIG. 3, are attached to the vamp panel portions. As clearly shown in FIG. 1, the first and second vamp portions 30 and 32 are separated by V-shaped slits 40 and the second and third vamp portions 32 and 34 are separated by a V-shaped slit 42 said slits providing flexibility of the vamp in facilitating independent movement of the vamp sections.

Referring now more specifically to the lacing connection of the boot 10, it will be understood that said boot is provided with a single continuous lace 44 having opposed side lengths 46 terminating in reinforced ends 48. The lace 44 cooperates with the vamp sections to provide a lacing assembly, in which the lace interconnects the first, second and third vamp portions 30, 32 and 34, respectively, and provides for adjusting the fit of the said vamp portions for the comfort of the wearer. More particularly, the first vamp portions 30 are provided with a plurality of opposed eyelets 52, constituting lace-receiving means, and importantly opposed double-loop fasteners 54, constituting lace-receiving locking means. The second vamp portions 32, which are separated from the first vamp portions 30 by the V-shaped split 52, include a plurality of eyelets 56, providing means receiving the lace side lengths 46. Finally, the third vamp portions 34, which are separated from the second vamp portions 32 by the V-shaped split 52 include a plurality of U-shaped single loop elements 58 attached to the third vamp portion 34, as by riveting, and having a bight portion spaced from the margin of said vamp portion and cooperating with said margin to provide means receiving the lace side lengths 46.

In the preferred embodiment, and as clearly shown in FIG. 2, each of the opposed double loop fasteners 54 includes a base portion 60 formed from a folded strap which is attached to the vamp and tongue as by a rivet 62 and defines an opening 64. The fasteners 54, referred to as double "D" ring fasteners also include a pair of identical generally triangular, overlying wire loop elements 66 and 68, said elements each having a hinge portion 70, received by the opening 64 in hinged relation, and an apex portion 72.

As clearly shown in FIG. 2, each lace side length 46 is received through both the upper and lower wire elements 66 and 68 and is re-entrantly doubled backed to be received through the lower wire elements 66 in locking relation to secure the lace in frictional engagement when tension is applied to the lace. Because of this relationship the first and second vamp sections can be independently and selectively adjusted for the comfort of the wearer.

It is thought that the structural features and functional advantages of this lacing assembly have become fully apparent from the foregoing description of parts, but for completeness of disclosure the adjustment of the fit of the vamp sections and the locking of the lacing assembly will be briefly described.

Initially the lace 44 is loosely threaded into place within the eyelets 52 and double-looped fasteners of the first vamp portions 30, the eyelets of the second vamp portions 32 and the U-shaped loops of the third vamp portions 34. The foot of the wearer can then be easily inserted into the boot 10. When this has been accomplished, the fit of the first vamp section can be adjusted by pulling the slack out of the lace side lengths 46 below the double fastener 54 and pulling the lace lengths through the wire elements 66 and 68 as shown in phantom outline in FIG. 2. The lace lengths 46 in the first vamp section are adjusted by pulling on the upward portion of these lace lengths which draws the upper and lower elements 66 and 68 together and effectively locks the lace in place the locking action increasing when tension is applied to the lace tending to draw the elements into binding engagement with the lace. Following this adjustment, the forward foot portion and the toes of the wearer are comfortably gripped by the lower first vamp section to the desired fit of the wearer. The remainder of the lace lengths above the double fasteners 54 can then be adjusted while maintaining the fit of the first vamp section, and the second, (intermediate) and third (upper) vamp sections can then be adjusted substantially independently of the first vamp section to comfortably grip the portion of the foot to which they are adjacent. The adjustment of the upper two vamp sections is accomplished independently of and without disturbing the fit of the lower vamp section because of the locking action of the double-loop fasteners 54. The free ends of the lacing at the top of the boot 10 can then be tied or otherwise secured in a conventional fashion.

As an alternative to the above, the lacing of the first vamp section can be accomplished to provide a comfortable fit and then the remaining portion of the lace threaded through the eyelets and the fasteners of the second and third vamp sections. In any event, the oppositely disposed double-loop fasteners of the first vamp section are adjusted to the comfort of the wearer independently and will remain adjusted until such time as positive action is taken by the wearer to readjust this vamp section which can remain adjusted to the foot of the wearer even though the upwardly adjacent lace portion is loosened to remove the boot. It will be understood that although the preferred embodiment is shown as a boot, the lacing assembly can be used for other articles of footwear having two or more vamp sections.

I claim as my invention:

1. In a lacing assembly for an article of footwear:

(a) a first vamp section including opposed vamp portions and a second vamp section, disposed upwardly adjacent of the first vamp section and including opposed vamp portions, (b) the first vamp portions including opposed lace-receiving means at the lower end thereof and a pair of opposed transversely spaced and separate lace-receiving locking means upwardly adjacent of said lace-receiving means each separate from the other and attached to an associated vamp portion, (c) the second vamp portions including a plurality of opposed lace receiving means, and (d) a single continuous lace having opposed side lengths, said side lengths being received by opposed lace-receiving means and said opposed lace-receiving locking means in said first vamp portions, and said side lengths extending between said first and second vamp sections and being received by opposed lace-receiving means in said second vamp portions, said lace being received by said lace-receiving locking means in selectively lockable relation to permit the first vamp section to be adjusted and maintained in adjustement substantially independently of the second vamp section.

2. A lacing assembly as defined in claim 1, in which:

(e) the lace-receiving locking means in the first vamp section are double-loop fasteners.

3. A lacing assembly as defined in claim 2, in which:

(f) each double-loop fastener includes a base portion attached to the vamp portion and having an opening, and a pair of overlying wire loop elements each having a hinge portion received by the base opening in hinge relation.

4. A lacing assembly as defined in claim 3, in which:

(g) the wire fastener loops are generally triangular in configuration to provide an outer apex portion.

5. A lacing assembly as defined in claim 1, in which:

(e) a third vamp section is disposed upwardly adjacent of the second vamp section and includes opposed vamp portions, (f) the third vamp portions including a plurality of opposed lace-receiving means.

6. A lacing assembly as defined in claim 5, in which:

(g) the article of footwear is a boot having upwardly extending upper side portions providing the third vamp section.

7. A lacing assembly as defined in claim 6, in which:

(h) the lace-receiving means in the first vamp portions are eyelets, (i) the lace-receiving locking means in the first vamp portion are double-loop fasteners, and (j) the lace-receiving means in the third vamp section are U-shaped single loop elements.

8. A lacing assembly as defined in claim 5, in which:

(g) the first, second and third vamp sections are separated by V-shaped slits between upwardly adjacent vamp portions.

* * * * *